US006109550A

United States Patent [19]

Haikkala et al.

[11] Patent Number: 6,109,550

[45] Date of Patent: Aug. 29, 2000

[54] ARRANGEMENT FOR PROVIDING CONTINUOUS GRINDING IN A PULP GRINDER

[75] Inventors: Pekka Haikkala, Siivikkala; Kari Pärssinen, Tampere; Jouko Hautala, Tampere; Olli Tuovinen, Tampere; Heikki Liimatainen, Tampere; Simo Setälä , Tampere, all of Finland

[73] Assignee: Valmet Corporation, Helsinki, Finland

[21] Appl. No.: 09/319,287

[22] PCT Filed: Dec. 12, 1997

[86] PCT No.: PCT/FI97/00781

§ 371 Date: Jul. 22, 1999

§ 102(e) Date: Jul. 22, 1999

[87] PCT Pub. No.: WO98/27266

PCT Pub. Date: Jun. 25, 1998

[30] Foreign Application Priority Data

Dec. 16, 1996 [FI] Finland ..... 965046

[51] Int. Cl.[7] ..... D21B 1/26

[52] U.S. Cl. ..... 241/27; 241/28; 241/29; 241/186.35; 241/281; 241/282

[58] Field of Search ..... 241/280, 281, 241/282, 186.35, 27, 28, 29

[56] References Cited

U.S. PATENT DOCUMENTS

| | | | |
|---|---|---|---|
| 1,518,583 | 12/1924 | Jones . | |
| 1,626,015 | 4/1927 | Ullgren | 241/282 |
| 1,644,148 | 10/1927 | Priem . | |
| 1,652,044 | 12/1927 | Nenzel | 241/281 |
| 2,297,438 | 9/1942 | Stehr | 241/281 |
| 4,305,590 | 12/1981 | Haikkala et al. | 241/282 X |
| 4,595,150 | 6/1986 | Aario | 241/282 |
| 4,840,317 | 6/1989 | Henrich | 241/282 |

FOREIGN PATENT DOCUMENTS

| | | |
|---|---|---|
| 0 266 582 A1 | 5/1988 | European Pat. Off. . |
| 83792 | 5/1991 | Finland . |
| 28 12 299 A1 | 9/1979 | Germany . |

*Primary Examiner*—John M. Husar
*Attorney, Agent, or Firm*—Alston & Bird LLP

[57] ABSTRACT

An arrangement for providing continuous grinding in a pulp grinder comprising a feed chute and a piston in the feed chute moving lengthwise of the feed chute for pressing the wood in the feed chute against a grindstone. The arrangement comprises rotary feed members between the piston and the grindstone on the sides of the feed chute for pushing the compressed wood further against the grindstone. Also, the arrangement comprises a closing member that can be pushed between the compressed wood and the piston to prevent the wood from moving backward with the piston as the piston is moved to the initial position, ready for the stroke, to allow the feed of a new batch of wood.

14 Claims, 4 Drawing Sheets

ARRANGEMENT FOR PROVIDING CONTINUOUS GRINDING IN A PULP GRINDER

FIELD OF THE INVENTION

The invention relates to an arrangement for providing continuous grinding in a pulp grinder comprising a grindstone, a feed chute extending to the grindstone, a piston for pressing the wood in the feed chute against the grindstone, and a closing member that can be moved crosswise of the feed chute to prevent the wood from moving backward from the grindstone when the piston is moved away from the grindstone.

BACKGROUND OF THE INVENTION

When wood is ground to produce fibers, the grinders typically used are grinders in which the blocks of wood are pressed against the surface of a rotary grindstone, simultaneously spraying water there to produce a pulp suspension. The most generally, the wood supply is implemented in pulp grinders on a discontinuous basis: one batch of wood at a time is fed into a feed chute, after which the wood in the feed chute is pressed by a cylinder against the grindstone. In order that the output would be as great as possible, two feed chutes, with cylinders, are usually arranged on the opposite sides of the grindstone. Consequently, when a feed chute is being filled, the grindstone is subjected to less load than when both the feed chutes are in the grinding step, and this causes both uneven loading and variation in the quality of the ground pulp. Further, the drawback of the discontinuous supply is that the output is smaller when the wood is fed in batches than when continuous grinding is used. Another problem in the discontinuous grinding is that the blocks of wood fed during the compression press more firmly against each other, which also results in variation between the production rates at the beginning and at the end of the grinding. Consequently, for example the freeness of the ground pulp is higher at the beginning of the compression, dropping toward the end of the furnace, even if the feed rate at the piston of the cylinder is adjusted to remain constant. For the same reason, the motor is loaded unevenly, and the loading increases toward the end of the compression.

Previously known are also continuous grinders in which the continuous wood supply is based on moving feed chains on both sides of a feed chute and on the weight of the wood in the feed chute. Such a grinder is known, for example, from German Offenlegungsschrift 28,12,299. The drawback of the solution is that to provide the continuous wood supply and sufficient compression, the chains must be rather long, which in practice means that the feed chute must be up to 6–8 meters high. The contact surface between the chains and the blocks of wood that are being fed is thus rendered sufficient, and the weight of the pile of wood simultaneously helps to press the wood against the feed chains for compression. Because of this, only an essentially upright feed chute can be used in the grinding process, which notably restricts the amount of wood that can be ground simultaneously. As a result, the capacity of the grinder is naturally smaller than in solutions where wood from two or more feed chutes can be ground simultaneously. Another problem in the high feed chutes is that the blocks of wood may settle obliquely, which affects the grindstone and because of which the grinder must be sharpened unduly often in order to correct the obliqueness. Since the pressing force of the chains does not divide evenly between the blocks of wood in the feed chute, but in practice the blocks of wood that are the closest to the chains are fed at a higher feed rate than those in the middle of the feed chute, this affects the quality and may also cause the above obliqueness.

SUMMARY OF THE INVENTION

The object of the invention is to provide an arrangement avoiding the drawbacks of the above embodiments and providing continuous and even wood supply to the grindstone. The arrangement of the invention is characterized by comprising rotary feed members between the piston and the grindstone on the opposite sides of the feed chute, the feed members pushing the wood in the feed chute toward the grindstone, and the piston comprising at least one recess, into which, behind the wood, the closing member can push as the piston presses the wood.

It is an essential idea of the invention that in addition to the cylinder and the piston connected thereto the invention comprises separate rotary feed members, which feed the batch of wood already compressed by the cylinder and the piston against the grindstone when the piston is moved away from the pressing position in order to feed a new batch of wood into the feed chute. Another essential idea of the invention is that the invention comprises a separate closing member that can be inserted behind the batch of wood compressed by the piston onto the side of the piston so that the batch of wood will not be able to move back from the compression when the piston is moved back in order to feed a new batch of wood.

The advantage of the invention is that the batch of wood is pressed by the piston, whereby the compressed batch of wood is easy to press further against the grindstone by rotary transfer members at that end of the feed chute which is close to the grindstone. Another advantage of the invention is that when the backward movement of the batch of wood has been prevented by the closing member, the piston can be moved to the initial position and a new batch of wood can be fed and subsequently pressed to compress it. The grinding conditions on the surface of the grindstone are thus maintained essentially constant, irrespective of the current state of compression of the last-fed batch of wood. Further, the wood can be fed so that the grinding is continuous although the wood is added in batches. Yet another advantage is that the entire feed chute can be designed relatively short as compared with the known solutions, and that more than one feed chute can be arranged to extend to one and the same grindstone, since the weight of the wood will no essentially affect the wood feed characteristics and thereby the quality of the ground pulp.

BRIEF DESCRIPTION OF THE DRAWINGS

The invention will be described in greater detail in the attached drawings, in which.

DETAILED DESCRIPTION OF THE PREFERRED EMBODIMENTS

Figure 1:
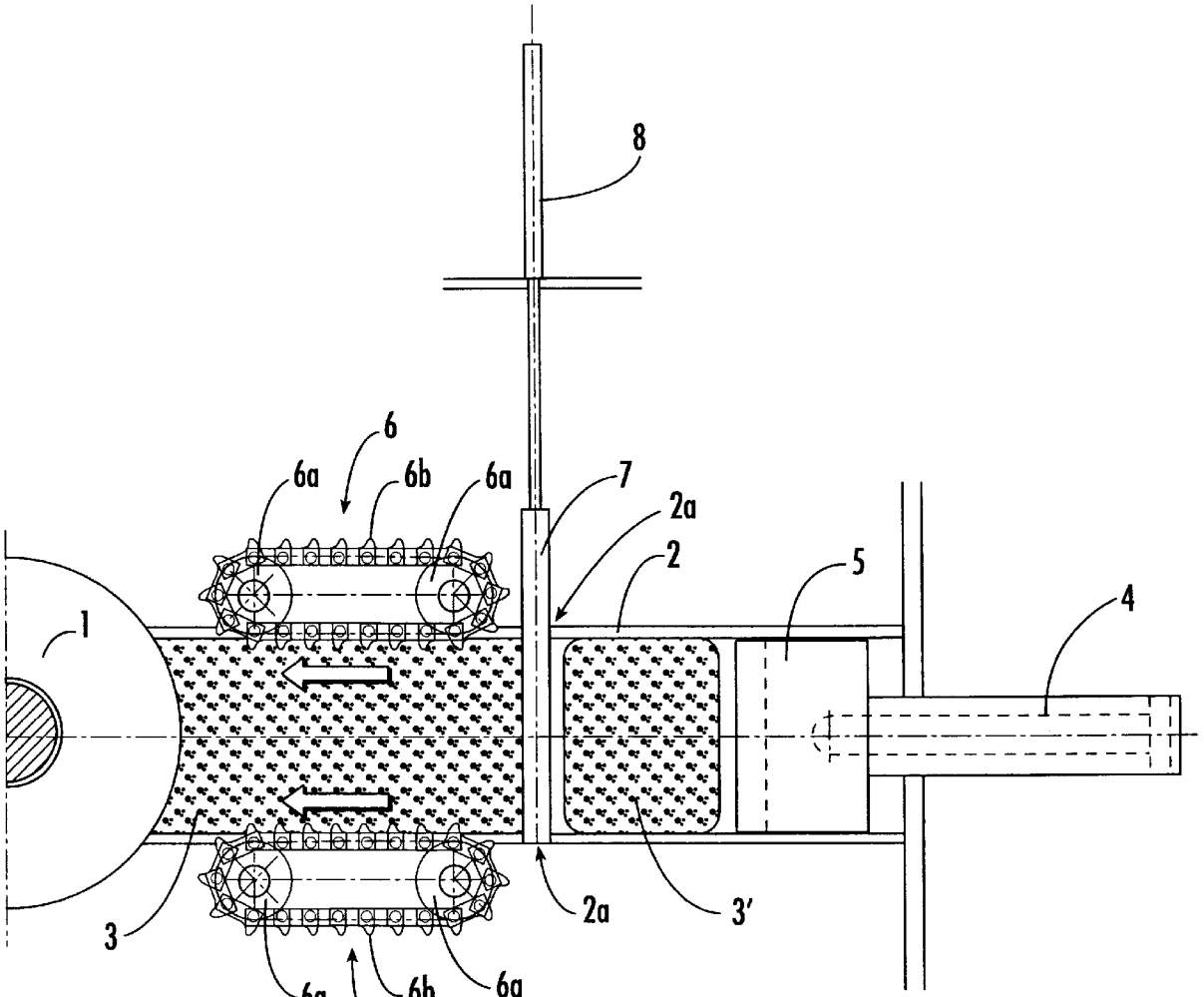
FIG. 1 is a schematic view of an embodiment of an arrangement according to the invention, showing a sectional side view of a feed chute.

FIG. 1 is a schematic view of a part of a grinder comprising a grindstone 1. Next to the grindstone 1 there is a feed chute 2, along which wood 3 is supplied against the grindstone 1 in a manner known per se. At the other end of the feed chute 2 there is a feed cylinder 4 comprising a piston 5 that pushes the wood against the grindstone 1. The wood is supplied in front of the piston 5 in batches 3', the batches being then pushed by the piston against the wood 3 that has been supplied to the feed chute 2 earlier. On the sides of the feed chute 2 there are rotary feed members 6, which in this embodiment consist of chains 6*b* running around return wheels 6*a*. As the chains 6*b* run around, they push the wood 3 toward the grindstone 1. Further, the figure shows a closing member 7 that can be moved by a closing cylinder 8 through apertures 2*a* in the walls of the feed chute 2 to behind the wood in the feed chute, between the piston 5 and the wood 3. This structure and the structure of the embodiments illustrated in FIGS. 2 and 3 are illustrated in greater detail in FIGS. 4*a* to 4*c*.

The operation of the arrangement and thereby of the grinder will be discussed in greater detail after the description of embodiments 2 and 3.

Figure 2:
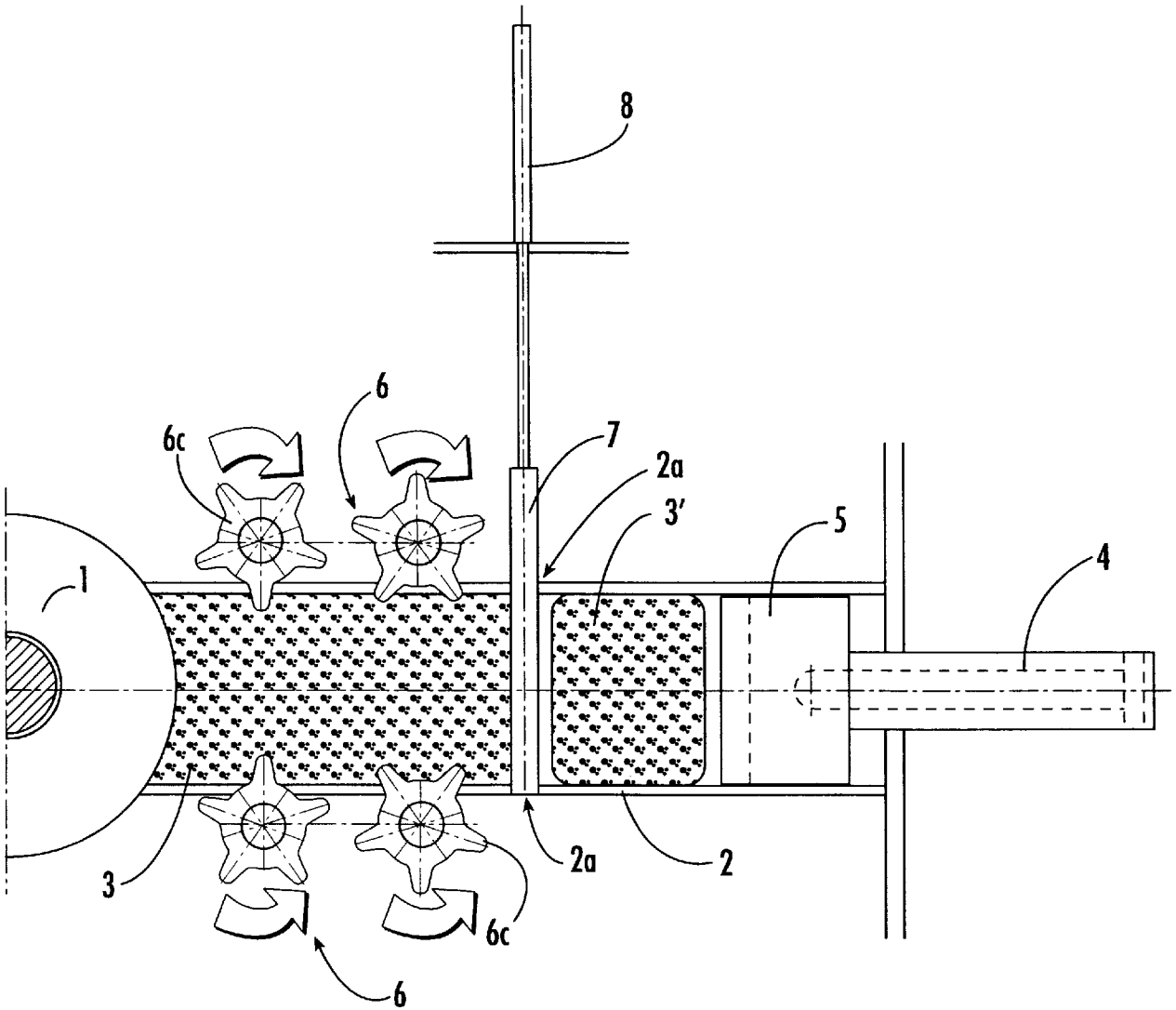
FIG. 2 is a schematic view of a second embodiment of an arrangement according to the invention, showing a sectional side view of a feed chute.

FIG. 2 is a schematic view of an embodiment that is otherwise similar to that of FIG. 1 except that the rotary feed members 6 are here gears provided with long teeth 6*c* extending to the feed chute 2, the teeth transferring the wood 3 that is between the closing member 7 and the grindstone 1 toward the grindstone 1 as the gears rotate.

Figure 3:
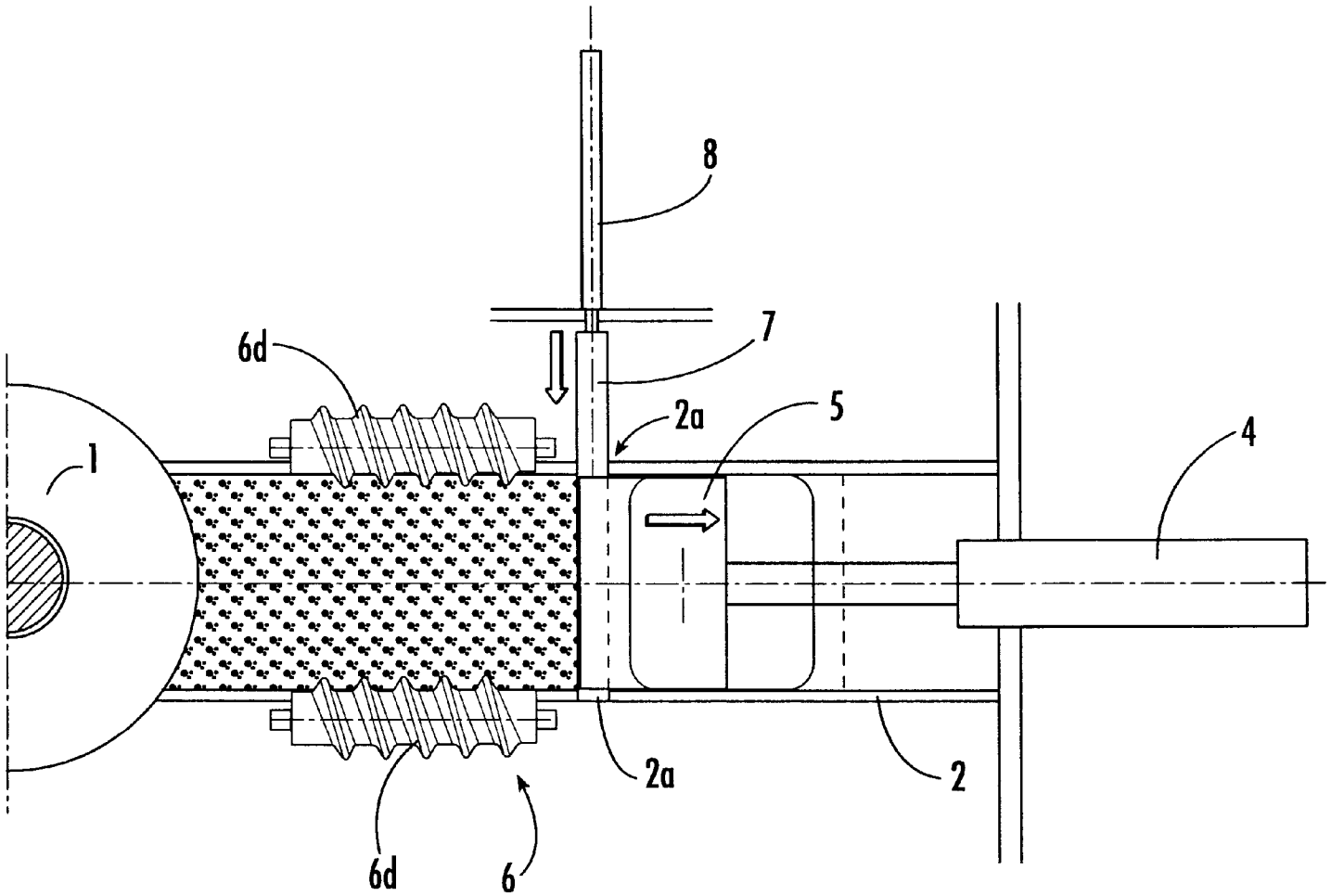
FIG. 3 is a schematic view of a third embodiment of an arrangement according to the invention, showing a sectional side view of a feed chute.

FIG. 3 in turn shows an embodiment that is otherwise similar to that of FIG. 1 except that the rotary feed members 6 are here coarse-teeth screws rotating about axles in the longitudinal direction of the feed chute 2 and thereby transferring the wood 3 on their screw surface 6*d* toward the grindstone 1.

All the embodiments of the arrangement according to the invention operate, in principle, in the same way. Once a new batch of wood has been fed into the grinder in the manner shown in FIG. 1, the piston 5 pushes the wood toward the grindstone 1, whereby the closing member 7 is pulled away from between the new batch of wood 3' and the wood 3 that is already being compressed in the feed chute, whereby the piston 5 can push the entire batch of wood toward the grindstone. The rotary feed members 6 operate simultaneously, helping to transfer the wood toward the grindstone 1. When the piston 5 is in the position shown in FIG. 3 so that that edge of the batch of wood 3 which is on the side of piston is past the closing member 7 closer to the grindstone 1, the closing member 7 is pushed by the closing cylinder 8 in a crosswise direction of the feed chute 2 behind the wood 3, whereby it prevents the wood 3 from moving backward when the piston 5 is pulled away so that it no longer presses the wood 3. The piston 5 is now pulled in the rearmost position in the manner shown in FIG. 1, and a new batch of wood 3' is fed through an aperture on the side of the feed chute 2 into the feed chute 2 in the manner known per se, for example, from Finnish Patent 69,653. The compression step is then repeated in the same manner. As shown in all FIGS. 1 to 3, the rotary feed members are located on those sides of the feed chute 2 which are parallel to the axle of the grindstone 1. This results from the fact that the wood 3 in the feed chute 2 is also parallel to the axle of the grindstone 1, whereby the wood is easier to supply evenly. Further, the closing member 7 is arranged to move crosswise of the feed chute 2 between the sides, i.e. crosswise of the axle of the grindstone 1, whereby the closing member 7 is behind the wood 3 crosswise thereof, and the surfaces of piston that are in contact with wood are also crosswise thereof.

Figure 4A:
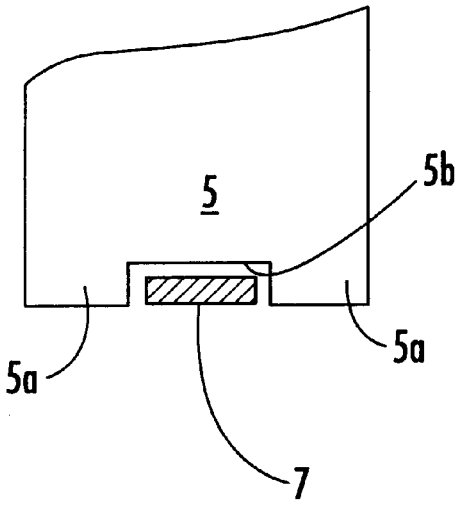
FIGS. 4*a* and 4*b* are schematic views of some embodiments of a closing member 7 and of corresponding piston structures.
Figure 4B:
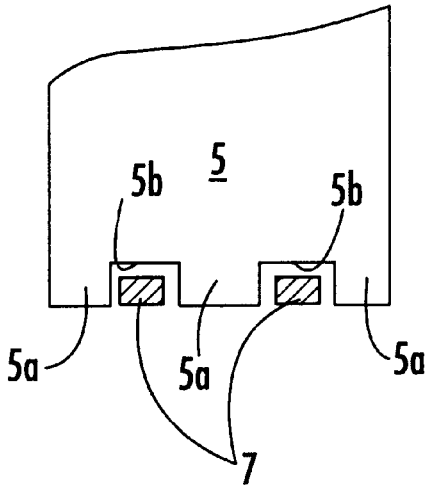

FIGS. 4*a* and 4*b* are schematic views showing different ways of arranging the closing member 7 and the piston 5 in relation to each other so that they can co-operate easily. FIG. 4*a* shows a potential shape of the piston 5 seen from the direction of the closing member 7. In this embodiment the piston 5 comprises two parts 5*a* pressing the wood, and a recess 5*b* between them. The cross-section of the closing member 7, in turn, is such that the closing member fits the recess 5 between the wood 3 and the piston 5. The closing member 7 can thus be pushed behind the wood 3 through the apertures 2*a* in the feed chute 2, so that when the piston 5 is moved backward and it no longer presses the wood 3, the closing member 7 will rest on the apertures 2*a* of the feed chute 2 and prevent the wood 3 from moving backward with the piston 5. FIG. 4*b* in turn shows another embodiment in which the piston 5 comprises three parts 5*a* pressing the wood, and two recesses 5*b* between the parts. Correspondingly, the closing members 7 comprise two parts that can be moved crosswise of the feed chute 2 and that fit the recesses 5*b*. This embodiment allows the wood 3 to be pressed more evenly, which may be useful.

The above description and the drawings present the invention only by way of example, without limiting it in any way. The essential feature is that the invention comprises a compression cylinder with a piston by which the wood can be pressed against the grindstone. Another essential feature is that the invention comprises rotary feed members by which the wood compressed by the piston in the feed chute can be pressed further against the grindstone when the piston is moved away from the pressing position so as to allow a new batch of wood to be fed. Yet another essential feature is that the invention comprises a closing member preventing the compressed wood from moving backward after the compression when the piston is moved away from the pressing position.

The arrangement of the invention can be applied in many different ways. For example, there may be one or more feed chutes per one grindstone, provided with the above parts. The feed chutes can be arranged horizontally, vertically or obliquely, since the direction does not have an essential effect on their operation. Continuous grinding is thereby achieved, in which the grinding situation and therefore the operating conditions and characteristics of the grinder stay essentially constant and in which the ground pulp obtained is of more even quality and the loading of the motor of the grinder is also more even.

The invention is not limited to a pulp grinder of a certain type. It can thus be used in both non-pressure grinders and pressure grinders, the other necessary operations and apparatuses being implemented conventionally in a previously known manner so that they suit the solutions in question.

What is claimed is:

1. An apparatus for providing continuous grinding of wood in a pulp grinder, said apparatus comprising:

a grindstone;

a feed chute extending to the grindstone for feeding wood therein to the grindstone along a feed direction, said feed chute defining a width extending across the feed direction;

a piston movable between an extended position for pressing the wood in the feed direction against the grindstone and a withdrawn position for loading additional wood into the feed chute;

at least one rotary feed member positioned to engage the wood in the feed chute disposed between the piston and the grindstone and push the wood toward the grindstone; and a closing member movable across the feed chute at a position between the piston and the rotary feed member, said closing member being movable across the entire width of the feed chute when said piston is in the extended position to provide constant and uninterrupted pressing of the wood across the entire width of the feed chute even during loading of additional wood into the feed chute.

2. An apparatus as defined in claim 1 wherein said at least one rotary feed member further comprises a pair of chains running around return wheels on opposite sides of the feed chute.

3. An apparatus as defined in claim 1 wherein said at least one rotary feed member further comprises a pair of gears provided with teeth extending to the wood in the feed chute on opposite sides of the feed chute.

4. An apparatus as defined in claim 1 wherein said at least one rotary feed member further comprises a pair of screws on opposite sides of the feed chute and defining coarse thread surfaces extending to the wood in the feed chute.

5. An apparatus as defined in claim 1 wherein said at least one rotary feed member comprises a pair of rotary feed members each arranged on an opposite side of the feed chute.

6. An apparatus as defined in claim 5 wherein the grindstone further comprises a rotational axis and wherein the rotary feed members are each arranged on a side of the feed chute that is parallel to the rotational axis of the grindstone.

7. An apparatus as defined in claim 1 wherein the piston comprises a surface for pressing the wood against the grindstone, said surface defining at least one recess structured to receive the closing member between the piston and the wood when the piston is in the pressing position.

8. An apparatus as defined in claim 7 comprising a single recess positioned in a medial portion of the closing member.

9. An apparatus as defined in claim 7 wherein the piston further comprises at least two recesses and the piston comprises at least two complementary parts for being received in the recesses.

10. A method for providing continuous grinding of wood in a pulp grinder, said method comprising:

loading a load of wood into a feed chute;

extending a piston against the wood for pressing the wood against the grindstone so that the wood is ground into fibers;

rotating a rotary feed member in engagement with the wood to push the wood towards the grindstone;

moving a closing member entirely across the feed chute between the piston and the wood to prevent movement of the wood away from the grindstone;

withdrawing the piston away from the closing member; and loading another load of wood into the feed chute, said rotary feed member rotating step occurring at least after said closing member moving step thus providing constant and uninterrupted pressing of the wood across the entire width of the feed chute even during loading of additional wood into the feed chute.

11. A method as defined in claim 10 wherein said closing member moving step further comprises moving at least part of the closing member into a recess in the piston and wherein said piston withdrawing step occurs subsequent to said closing member moving step.

12. A method as defined in claim 10 further comprising rotating said rotary feed member contemporaneously with said piston extending step.

13. A method as defined in claim 10 comprising the further step of removing the closing member from the feed chute after said step of loading another load of wood into the feed chute.

14. A method as defined in claim 13 comprising the further step of moving the piston against the wood in the feed chute after the closing member has been removed to continue pressing of the wood against the grindstone.

* * * * *